US011408154B2

(12) United States Patent
Li et al.

(10) Patent No.: US 11,408,154 B2
(45) Date of Patent: Aug. 9, 2022

(54) ROUGH-IN ASSEMBLY FOR FREE-STANDING FAUCET

(71) Applicant: Globe Union Industrial Corp., Taichung (TW)

(72) Inventors: Chunhung Li, Taichung (TW); Yung-Cheng Yu, Taichung (TW); Jiun-Li Tsai, Taichung (TW); Chu-Cheng Chu, Taichung (TW)

(73) Assignee: Globe Union Industrial Corp., Taichung (TW)

( * ) Notice: Subject to any disclaimer, the term of this patent is extended or adjusted under 35 U.S.C. 154(b) by 329 days.

(21) Appl. No.: 16/689,186

(22) Filed: Nov. 20, 2019

(65) Prior Publication Data

US 2020/0217052 A1 Jul. 9, 2020

(30) Foreign Application Priority Data

Jan. 7, 2019 (CN) ..... 201920019825.6

(51) Int. Cl.
*E03C 1/04* (2006.01)

(52) U.S. Cl.
CPC ..... *E03C 1/0401* (2013.01); *E03C 1/0403* (2013.01)

(58) Field of Classification Search
CPC ..... E03C 1/0401; E03C 1/0403
See application file for complete search history.

(56) References Cited

U.S. PATENT DOCUMENTS

| | | | | |
|---|---|---|---|---|
| 5,010,922 | A * | 4/1991 | Agresta | E03C 1/0401 137/216 |
| 6,256,810 | B1 * | 7/2001 | Baker | E03C 1/0401 4/678 |
| 6,792,629 | B2 * | 9/2004 | Nelson | E03C 1/0401 4/695 |
| 9,334,633 | B2 | 5/2016 | Harris et al. | |
| 9,677,256 | B2 * | 6/2017 | Wilson | E03C 1/025 |
| 2004/0065367 | A1 * | 4/2004 | Thomas | E03C 1/0401 137/359 |
| 2004/0078893 | A1 * | 4/2004 | Bloom | E03C 1/0401 4/695 |
| 2008/0152523 | A1 * | 6/2008 | Jensen | F04B 53/16 417/571 |
| 2013/0180601 | A1 * | 7/2013 | Li | E03C 1/0402 137/315.01 |

(Continued)

*Primary Examiner* — Patrick C Williams
(74) *Attorney, Agent, or Firm* — Alan D. Kamrath; Karin L. Williams; Mayer & Williams PC

(57) ABSTRACT

A rough-in assembly for mounting a free-standing faucet on a floor is revealed. The rough-in assembly includes a mounting base, a connection tube set having cold-water and hot-water connection tubes, a fixing plate, and a plurality of nuts. The mounting base consists of a bottom plate fixed on a laminated wood, a tube-fixing portion positioned on the bottom plate and provided with two locking slots, and a plurality of bolts projecting from the bottom plate and inserted through a mounting hole on the floor. The cold-water and hot-water connection tubes are locked in the two locking slots of the tube-fixing portion. The fixing plate allows the bolts of the mounting base to pass therethrough. The nuts are threaded on the bolts for fastening the fixing plate on the floor. Thereby the free-standing faucet is secured on the floor firmly and production cost is dramatically reduced.

16 Claims, 14 Drawing Sheets

(56) References Cited

U.S. PATENT DOCUMENTS

2013/0333109 A1* 12/2013 Li ..... E03C 1/0402
4/695
2019/0032308 A1* 1/2019 Hsieh ..... E03C 1/042

* cited by examiner

ROUGH-IN ASSEMBLY FOR FREE-STANDING FAUCET

BACKGROUND OF THE INVENTION

Field of the Invention

The present invention relates to a free-standing faucet, especially to a rough-in assembly for free-standing faucets.

Description of Related Art

A typical free-standing faucet is disposed on a floor around a tub for filling water into the tab. Refer to U.S. Pat. No. 9,334,633, a tub filler faucet assembly for coupling to a floor is revealed. The tub filler faucet assembly includes a free-standing spout spaced apart from a tub wall; a valve assembly fluidly coupled to the spout; a free-standing mounting assembly spaced apart from the tub wall and coupled to the spout and a top surface of the floor; and a rough-in assembly positioned below the floor and coupled to the free-standing mounting assembly. The rough-in assembly includes at least one passageway fluidly coupled to the valve assembly.

The rough-in assembly further includes a cold-water inlet tube, a hot-water inlet tube, a base and a cover that conceals the inlet tubes and a portion of the base. At least a part of the rough-in assembly is positioned below the floor while other portions of the rough-in assembly extend above the floor.

It should be particularly noted that the base is integrally produced by casting and made from copper-based metals in order to make the base have passageways that allow water to flow therein. The base produced has the shortcomings of high production cost and too much weight. The faucet can be installed by the top surface of the base being fixed on the bottom of the floor. Yet the faucet installed is easy to get loose and move around because that the area of the bottom surface of the base is smaller and the total weight of the base and the floor acts on the ground under the floor through the bottom surface of the base. Thus the free-standing faucet is wobbly while being touched or contacted by users in use.

SUMMARY OF THE INVENTION

Therefore it is a primary object of the present invention to provide a rough-in assembly that is having simple structure and easily produced. Thus not only the production cost is significantly reduced, the design also makes the free-standing faucet assembly more stable and firm after installation, without shaking while in use.

In order to achieve the above object, a rough-in assembly used for coupling a free-standing faucet to a floor according to the present invention is provided. The free-standing faucet consists of a valve assembly, a spout connected to the valve assembly, an inlet tube set connected to the valve assembly, and a free-standing casing tube connected to the valve assembly. The inlet tube set is mounted in the free-standing casing tube and is composed of a cold-water inlet tube and a hot-water inlet tube. The rough-in assembly according to the present invention includes a mounting base, a connection tube set, a fixing plate and a plurality of nuts.

The mounting base includes a bottom plate, a tube-fixing portion positioned on an upper surface of the bottom plate, and a plurality of bolts projecting from the upper surface of the bottom plate. The bottom plate is secured on a laminated wood while two locking slots are formed on the tube-fixing portion and located in the area defined by the bolts. The bolt is inserted through a mounting hole on the floor and extending upward.

The connection tube set consists of a cold-water connection tube and a hot-water connection tube which are locked and positioned in the two locking slots of the tube-fixing portion correspondingly. The cold-water connection tube includes a cold-water inlet end connected to a cold-water supply pipe and a cold-water outlet end connected to the cold-water inlet tube while the hot-water connection tube includes a hot-water inlet end connected to a hot-water supply pipe and a hot-water outlet end connected to the hot-water inlet tube.

The fixing plate which is provided with a plurality of insertion holes is connected to and disposed around the bottom end of the free standing casing tube. The bolts of the mounting base are inserted through the insertion holes respectively.

The nuts are threaded on the respective bolts of the mounting base correspondingly so as to thread and fasten the fixing plate on an upper surface of the floor.

The rough-in assembly further includes a decorative cover which is movably mounted to an outer peripheral wall of the free-standing casing tube and abutting against the upper surface of the floor. Thereby the fixing plate, the respective bolts and the nuts are covered by the decorative cover.

The tube-fixing portion of the rough-in assembly further includes two vertical plate portions opposite to each other and a horizontal plate portion connected between the vertical plate portions. The two locking slots of the tube-fixing portion are spaced apart and disposed on both the vertical plate portions and the horizontal plate portion. A part of the locking slot located at the vertical plate portion forms a vertical notch while a part of the locking slot arranged at the horizontal plate portion forms a horizontal notch which is communicating with the vertical notch. As to the cold-water connection tube and the hot-water connection tube, both are bent tubes each of which includes a horizontal portion, a vertical portion, and a curved portion located between the horizontal portion and the vertical portion. The cold-water inlet end and the hot-water inlet end are respectively formed on the rear ends of the two horizontal portions while the cold-water outlet end and the hot-water outlet end are respectively arranged at the rear ends of the two vertical portions. A part of the vertical portion close to the curved portion is locked and positioned in the horizontal notch of the locking slot while a part of the horizontal portion close to the curved portion is locked and positioned in the vertical notch of the locking slot.

In the locking slot of the rough-in assembly, one side of the horizontal notch away from the entry side is curved and having a locking portion with a smaller width. Thus the vertical portions of the cold-water and hot-water connection tubes are locked and positioned firmly in the locking portions after being laterally mounted into the locking slots.

The vertical plate portion of the tube-fixing portion of the rough-in assembly horizontally extends outward to form a connection plate which is fixed on the upper surface of the bottom plate.

In the mounting base of the rough-in assembly, the bottom plate is fixed on the upper surface of the laminated wood and is provided with a through hole so that the cold-water and hot-water connection tubes of the connection tube set can be inserted through the through hole and passed through the laminated wood. The tube-fixing portion is a piece of plate provided with a plurality of positioning holes. By the bolts being inserted through and positioned in the positioning holes, the tube-fixing portion (the piece of plate) is abutting against and positioned on the upper surface of the bottom plate. The tube-fixing portion is further provided with two openings which form the two locking slots.

The locking slot of the rough-in assembly is a slotted hole having one side thereof as an insertion side and the other side thereof as a locking side. The width of the insertion side is larger than that of the locking side. Thus both the cold-water connection tube and the hot-water connection tube can be inserted through the insertion sides and then horizontally sliding into the locking sides correspondingly.

An outer peripheral wall of both the cold-water connection tube and the hot-water connection tube is provided with a circular flange. The diameter of the support circular flange is between the width of the insertion side and the width of the locking side so that the wall surface of the support circular flange can be abutting against and supported by the upper surface on the locking side of the tube-fixing portion (the piece of plate).

The bottom plate of the mounting base of the rough-in assembly is also able to be fastened on the lower surface of the laminated wood and provided with a through hole so that the cold-water and hot-water connection tubes of the connection tube set can be inserted through the through hole and passed through the laminated wood. The tube-fixing portion is a piece of plate provided with a plurality of positioning holes. By the bolts being inserted through and positioned in the positioning holes, the tube-fixing portion (the piece of plate) is abutting against and positioned on the upper surface of the bottom plate. The tube-fixing portion is further provided with two openings which form the two locking slots.

The bottom plate of the rough-in assembly is fixed on the lower surface of the laminated wood by a plurality of fasteners.

The rough-in assembly of the present invention includes no passage in the mounting base so that there is no need to produce the mounting base integrally by casting copper-based alloys. The rough-in assembly used in combination with only copper-based pipes features on simple structure and easy production. Thus the production cost is significantly reduced. Moreover, the bottom plate of the rough-in assembly is directly disposed on the laminated wood. The design puts most of the weight of the free-standing faucet on the laminated wood. The free-standing faucet is secured more stably and firmly after installation compared with the prior arts because that the laminated wood provides a larger contact surface. Thus the free-standing faucet will not shake or move around while in contact with users' hands in use.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

Figure 1:
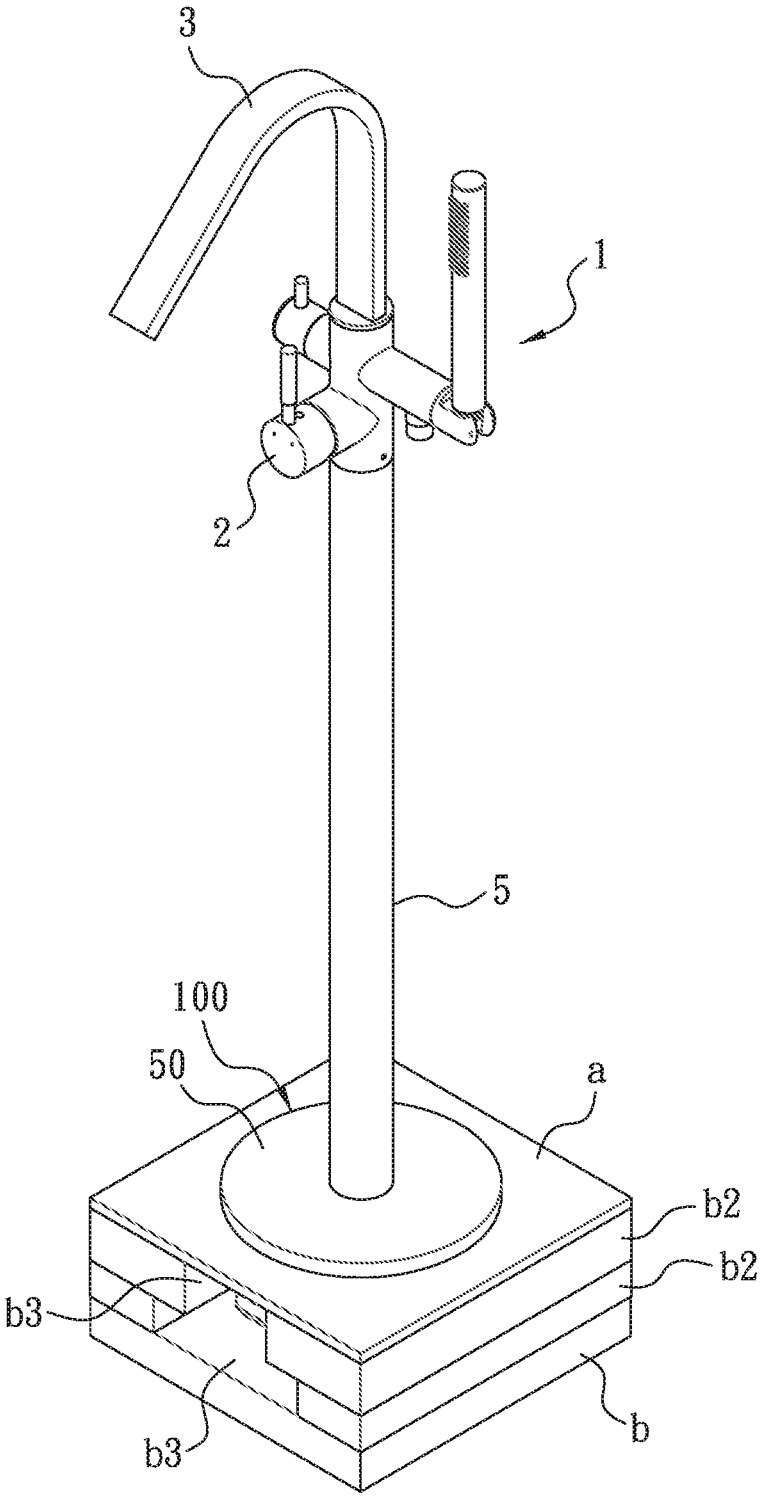
FIG. 1 is a perspective view of an embodiment of a rough-in assembly coupled to a free-standing faucet according to the present invention.

As shown in FIG. 1-4, an embodiment of a rough-in assembly 100 according to the present invention used for mounting a free-standing faucet 1 on a floor a, particularly the floor a around a tub is revealed. The floor a can be a tilt floor, a carpet floor, a wood floor, a laminate floor made from various materials, etc. The free-standing faucet 1 is basically separated from a tub and water flows into the tub through the free-standing faucet 1.

To be more precisely, the free-standing faucet 1 generally includes a valve assembly 2, a spout 3 connected to the valve assembly 2, an inlet tube set 4 connected to the valve assembly 2, and a free-standing casing tube 5 connected to the valve assembly 2. The inlet tube set 4 is mounted in the free-standing casing tube 5 and is composed of a cold-water inlet tube 4*a* and a hot-water inlet tube 4*b*. As to the rough-in assembly 100, it consists of a mounting base 10, a connection tube set 2, a fixing plate 30 and a plurality of nuts 40.

Figure 5:
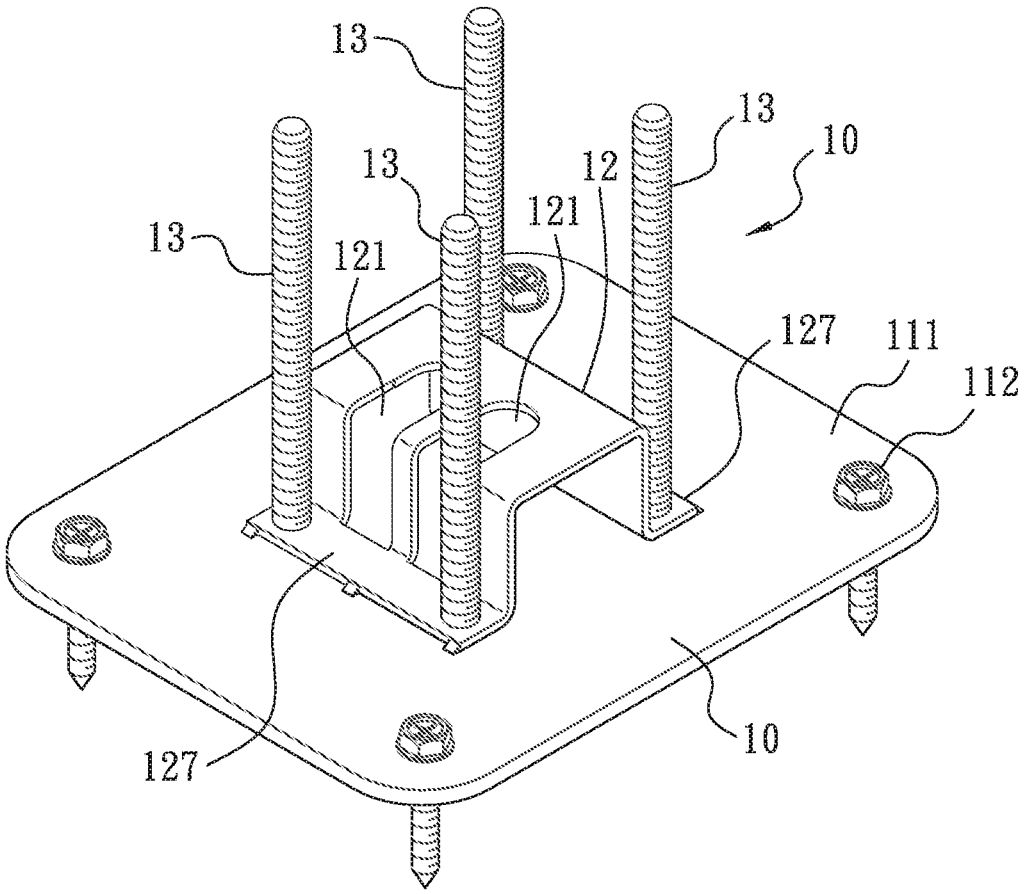
FIG. 5 is a perspective view of a mounting base of the embodiment in FIG. 1 according to the present invention.

Refer to FIG. 5, the mounting base 10 includes a bottom plate 11, a tube-fixing portion 12 positioned on an upper surface 111 of the bottom plate 11, and a plurality of bolts 13 projecting from the upper surface 111 of the bottom plate 11. The bottom plate 11 is fixed on a laminated wood b while two locking slots 121 are formed on the tube-fixing portion 12 and located in area defined by the bolts 13. The bolt 13 is inserted through a mounting hole a1 on the floor a and extending upward.

Figure 3:
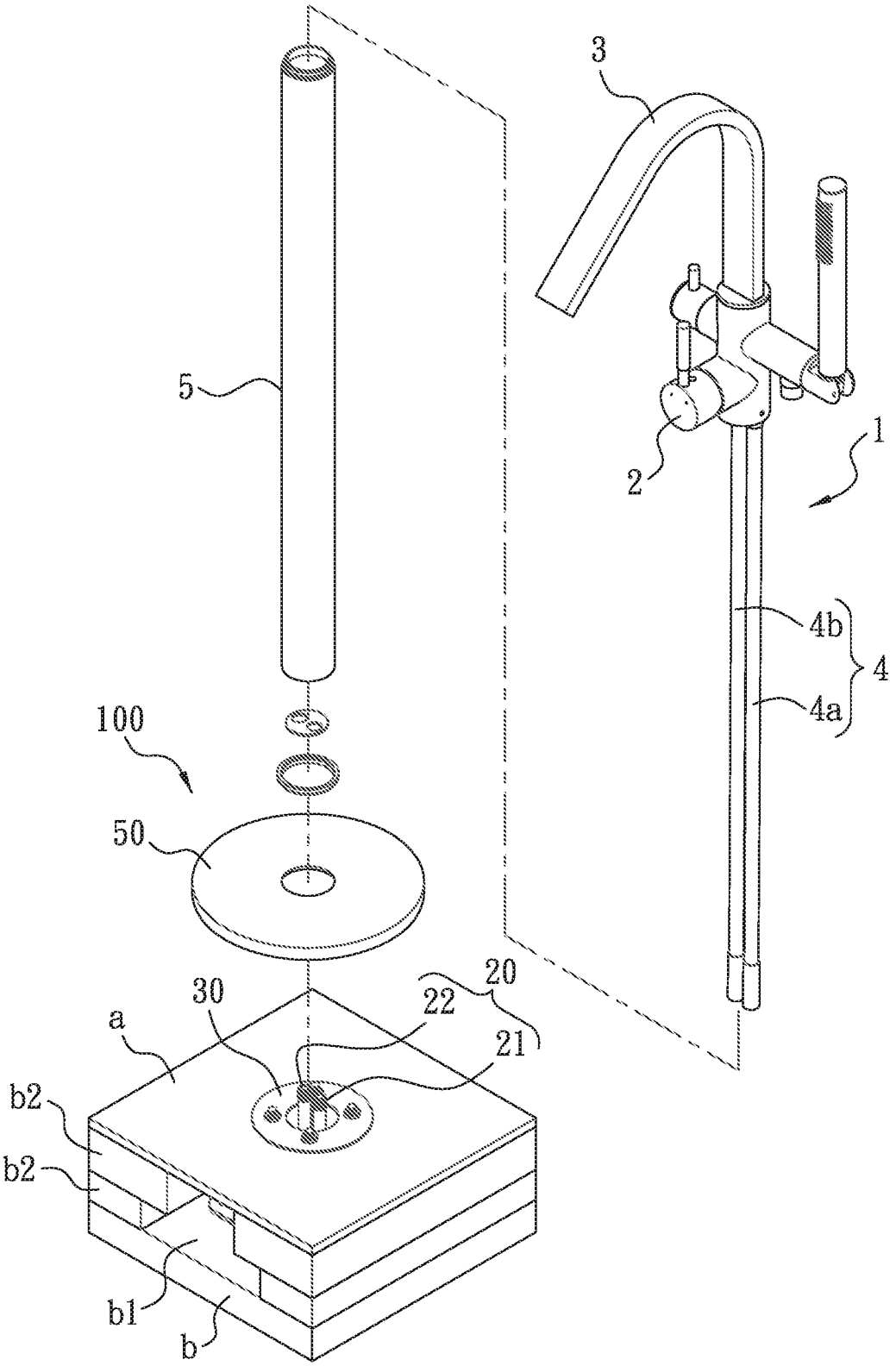
FIG. 3 is a partial explosive view of the embodiment in FIG. 1 according to the present invention.
Figure 4:
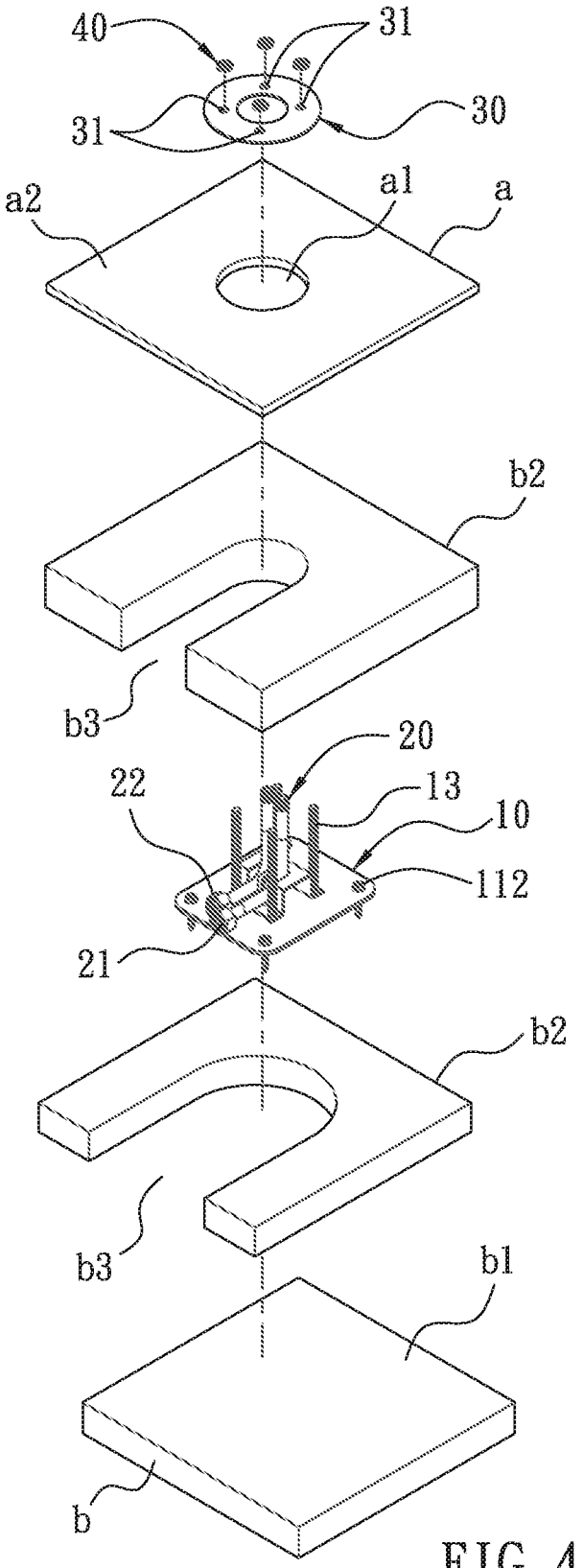
FIG. 4 is a partial explosive view of the embodiment in FIG. 1 used in combination with a floor, a laminated wood and pads according to the present invention.
Figure 6:
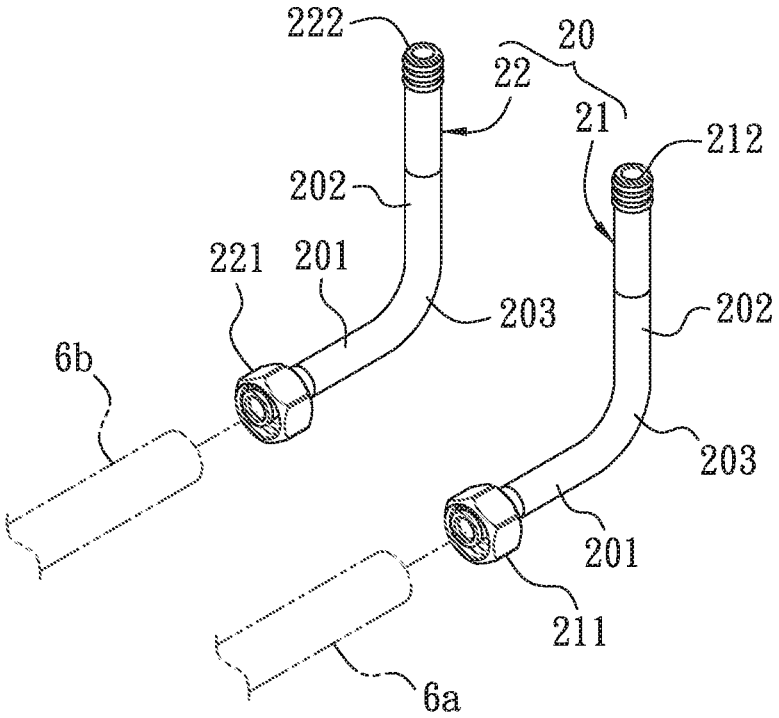
FIG. 6 is a perspective view of a connection tube set of the embodiment in FIG. 1 with a cold-water supply pipe and a hot-water supply pipe according to the present invention.

As shown in FIG. 4 and FIG. 5, the connection tube set 20 consists of a cold-water connection tube 21 and a hot-water connection tube 22 which are respectively locked and positioned in the two locking slots 121 of the tube-fixing portion 12. Refer to FIG. 3 and FIG. 6, the cold-water connection tube 21 includes a cold-water inlet end 211 connected to a cold-water supply pipe 6*a* and a cold-water outlet end 212 connected to the cold-water inlet tube 4*a*. The hot-water connection tube 22 includes a hot-water inlet end 221 connected to a hot-water supply pipe 6*b* and a hot-water outlet end 222 connected to the hot-water inlet tube 4*b*. According to the figures mentioned above, it is clearly learned that the cold-water supply pipe 6*a* and the hot-water supply pipe 6*b* in this embodiment are disposed horizontally. To put it another way, the connection tube set 20 in this embodiment is suitable for supply pipes arranged and extending horizontally.

Figure 2:
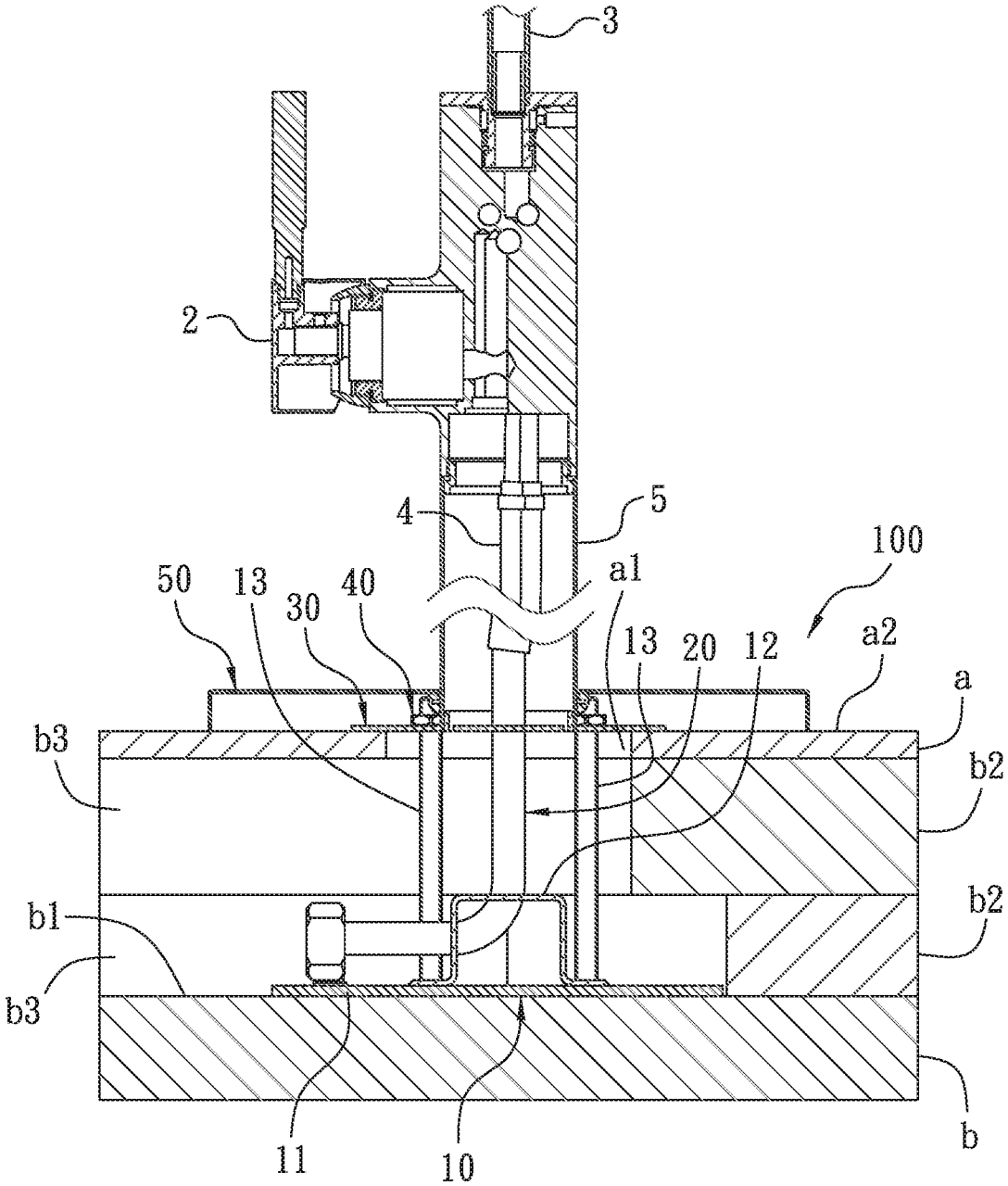
FIG. 2 is a partial longitudinal sectional view of the embodiment in FIG. 1 according to the present invention.

Refer to FIG. 2 and FIG. 4, the fixing plate 30 which is provided with a plurality of insertion holes 31 is connected to and arranged around the bottom end of the free standing casing tube 5. The bolts 13 of the mounting base 10 are inserted through the insertion holes 31 respectively. The fixing plate 30 can be connected with the free standing casing tube 5 by welding or other common ways.

As shown in FIG. 2 and FIG. 4, the respective nuts 40 are threaded on the respective bolts 13 of the mounting base 10 correspondingly so as to thread and fasten the fixing plate 30 on an upper surface a2 of the floor a.

As shown in FIG. 1 and FIG. 2, the rough-in assembly 100 further includes a decorative cover 50 which is movably mounted to an outer peripheral wall of the free-standing casing tube 5 and abutting against the upper surface a2 of the floor a. Thereby the fixing plate 30, the respective bolts 13 and the nuts 40 are covered by the decorative cover 50 for aesthetic purposes.

In this embodiment, the bottom plate 11 is secured on an upper surface b1 of the laminated wood b by a plurality of fasteners 112, as shown in FIG. 4 and FIG. 5. The fastener 112 can be, but not limited to, a screw. Other ways of fastening the bottom plate 11 are also possible.

Figure 7:
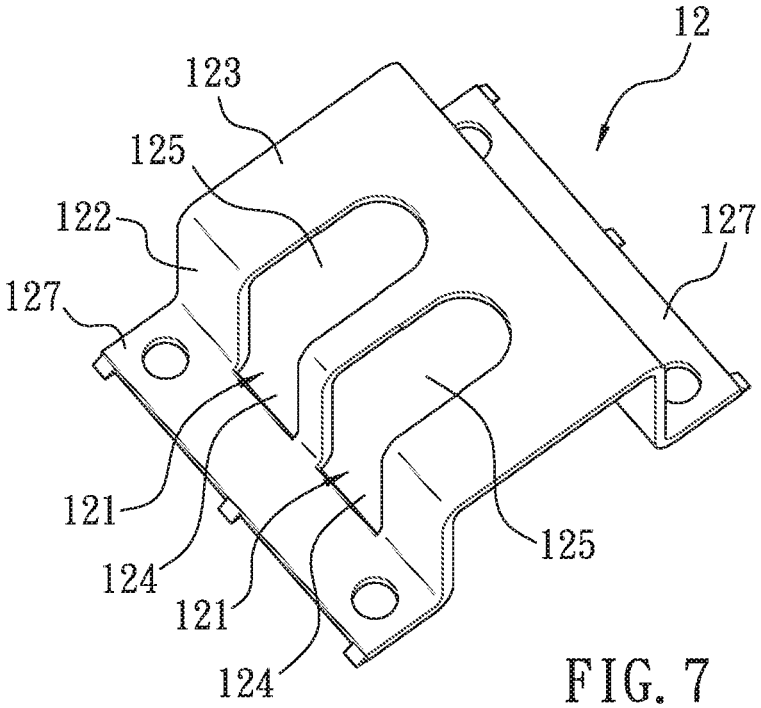
FIG. 7 is a perspective view of a tube-fixing portion of the embodiment in FIG. 1 according to the present invention.

Refer to FIG. 7, besides the two locking slots 121, the tube-fixing portion 12 further includes two vertical plate portions 122 opposite to each other, a horizontal plate portion 123 connected between the vertical plate portions 122, two vertical notches 124 and two horizontal notches 125. The locking slots 121 are spaced apart from each other and arranged at both the vertical plate portions 122 and the horizontal plate portion 123. A part of the locking slot 121 located at the vertical plate portion 122 forms the vertical notch 124 and a part of the locking slot 121 arranged at the horizontal plate portion 123 forms the horizontal notch 125 while the vertical notch 124 and the horizontal notch 125 are communicating with each other. As shown in FIG. 6, both the cold-water connection tube 21 and the hot-water connection tube 22 are bent tubes each of which includes a horizontal portion 201, a vertical portion 202, and a curved portion 203 located between the horizontal portion 201 and the vertical portion 202. The cold-water inlet end 211 and the hot-water inlet end 221 are respectively formed on the rear ends of the two horizontal portions 201. The cold-water outlet end 212 and the hot-water outlet end 222 are respectively arranged at the rear ends of the two vertical portions 202. A part of the vertical portion 202 close to the curved portion 203 is locked and positioned in the horizontal notch 125 of the locking slot 121 while a part of the horizontal portion 201 close to the curved portion 203 is locked and positioned in the vertical notch 124 of the locking slot 121.

Figure 8:
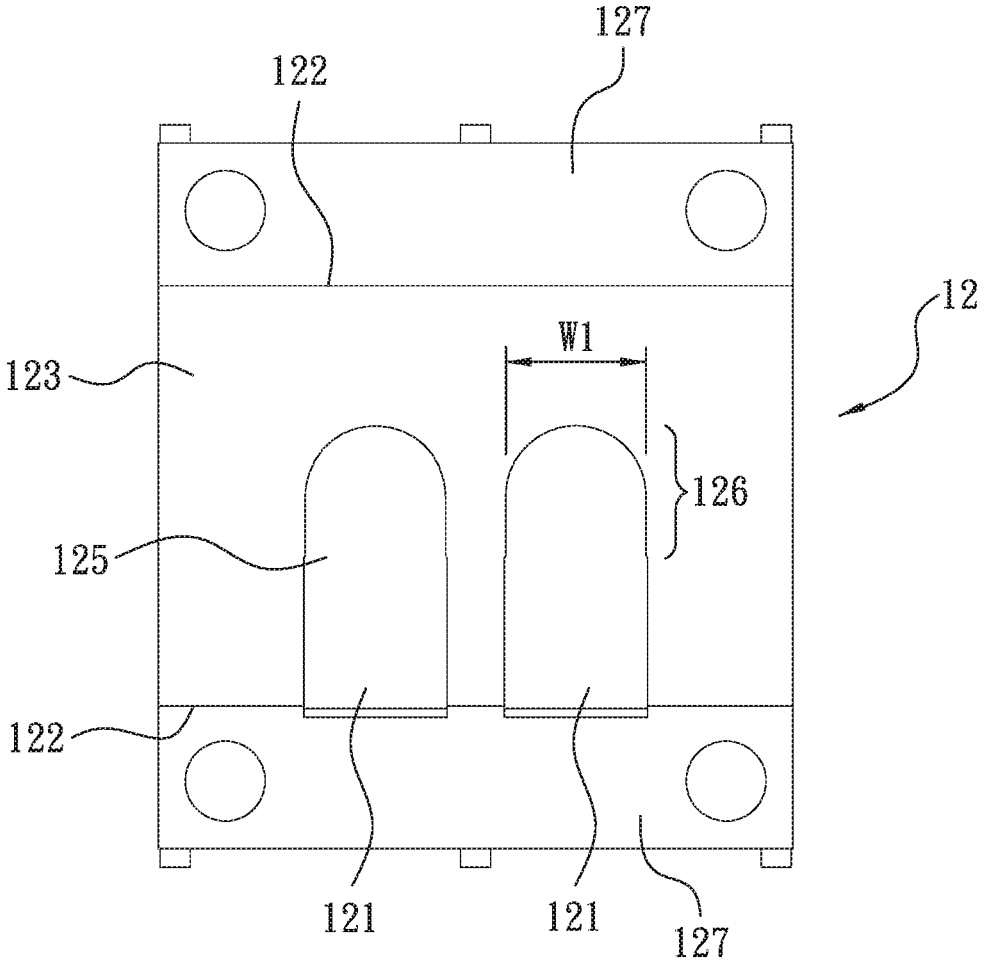
FIG. 8 is a top view of a tube-fixing portion of the embodiment in FIG. 1 according to the present invention.

Refer to FIG. 8, one side of the horizontal notch 125 of the locking slot 121 away from the entry side is curved and having a locking portion 126 with the width of W1 which is smaller than the width of the rest part of the locking slot 121. Thus the vertical portions 202 of both the cold-water connection tube 21 and the hot-water connection tube 22 are locked and positioned firmly in the two locking portions 126 after being laterally mounted into the locking slots 121 correspondingly. The design of the curved side and the locking portion 126 ensures that both the cold-water connection tube 21 and the hot-water connection tube 22 are positioned in the locking slots 121 more tightly. This also helps the following connection and fixing of the cold-water inlet tube 4*a* and the hot-water inlet tube 4*b*.

As shown in FIG. 7 and FIG. 8, the vertical plate portion 122 of the tube-fixing portion 12 horizontally extends outward to form a connection plate 127 which is fixed on the upper surface 111 of the bottom plate 11 by welding or other common ways.

In this embodiment, as shown in FIG. 5, each of the bolts 13 of the mounting base 10 is projecting from the upper surface of the connection plate 127. The bolt 13 can be directly fixed on the upper surface of the connection plate 127 by welding. Or after the bolt 13 being passed through and positioned by the connection plate 127, the connection plate 127 is fixed on the upper surface 111 of the bottom plate 11 so that the head of the bolt 13 is clipped between and fixed by the connection plate 127 and the upper surface 111 of the bottom plate 11.

As shown in FIG. 2, FIG. 3 and FIG. 4, it should be noted that the laminated wood b is used in combination with two pads b2 so that the lower surface of the floor a will not be in direct contact with the laminated wood b. The two pads b2 are stacked vertically and arranged between the floor a and the laminated wood b. Thus the floor a and the laminated wood b are spaced apart from each other. Each of the pads b2 is provided with an opening b3 which is having a certain size for receiving the mounting base 10 therein and for control of the length of the bolt 13 projecting from the mounting hole a1 of the floor a. In other words, plumbers first measures the dimensions of the site where they are going to install the free-standing faucet 1 (such as the thickness of the floor a) and the size of the components related to the free-standing faucet 1 (such as the mounting position of the cold-water supply pipe 6*a* and the hot-water supply pipe 6*b*) in order to produce the laminated wood b and the pads b2 with required thickness. The number of the pads is not limited. The pads b2 can even be directly formed on the laminated wood b. Alternatively, the two pads b2 are integrated into one part. The design of the pad b2 are not limited as long as the mounting base 10 can be fixed on the laminated wood b tightly and the length requirements for the bolt 13 projecting from the mounting hole a1 of the floor a are met. It should be noted that the laminated wood b and the pads b2 mentioned above are prepared or produced by the workers with reference to the product instructions of the present invention, thus they are not a part of the present rough-in assembly 100.

As shown in FIG. 2 and FIG. 4, in order to install the free-standing faucet 1 of the present invention, firstly the mounting base 10 is fastened to and fixed on the upper surface b1 of the laminated wood b prepared in advance. Then the cold-water connection tube 21 and the hot-water connection tube 22 of the connection tube set 20 are respectively horizontally mounted into the two locking slots 121 of the tube-fixing portion 12 and connected to the cold-water supply pipe 6*a* and the hot-water supply pipe 6*b* correspondingly. Next the two pads 2 are stacked over and under the laminated wood b so that the mounting base 10 is located in the respective openings b3. Then the respective bolts 13 are inserted through the respective mounting holes a1 on the floor a and extending upward after the floor a being covered on the assembly. Now the respective insertion holes 31 of the fixing plate 30 on the bottom of the free standing casing tube 5 are fitted to the respective bolts 13 while the cold-water outlet end 212 of the cold-water connection tube 21 and the hot-water outlet end 222 of the hot-water connection tube 22 are respectively connected to and communicating with the cold-water inlet tube 4*a* and the hot-water inlet tube 4*b*. Then the nuts 40 are respectively threaded onto the bolts 13 and tightened to install and fasten the free-standing faucet 1 on the mounting base 10 smoothly. Lastly, the fixing plate 30 is covered with the decorative cover 50 and the installation of the free-standing faucet 1 has been completed.

Figure 9:
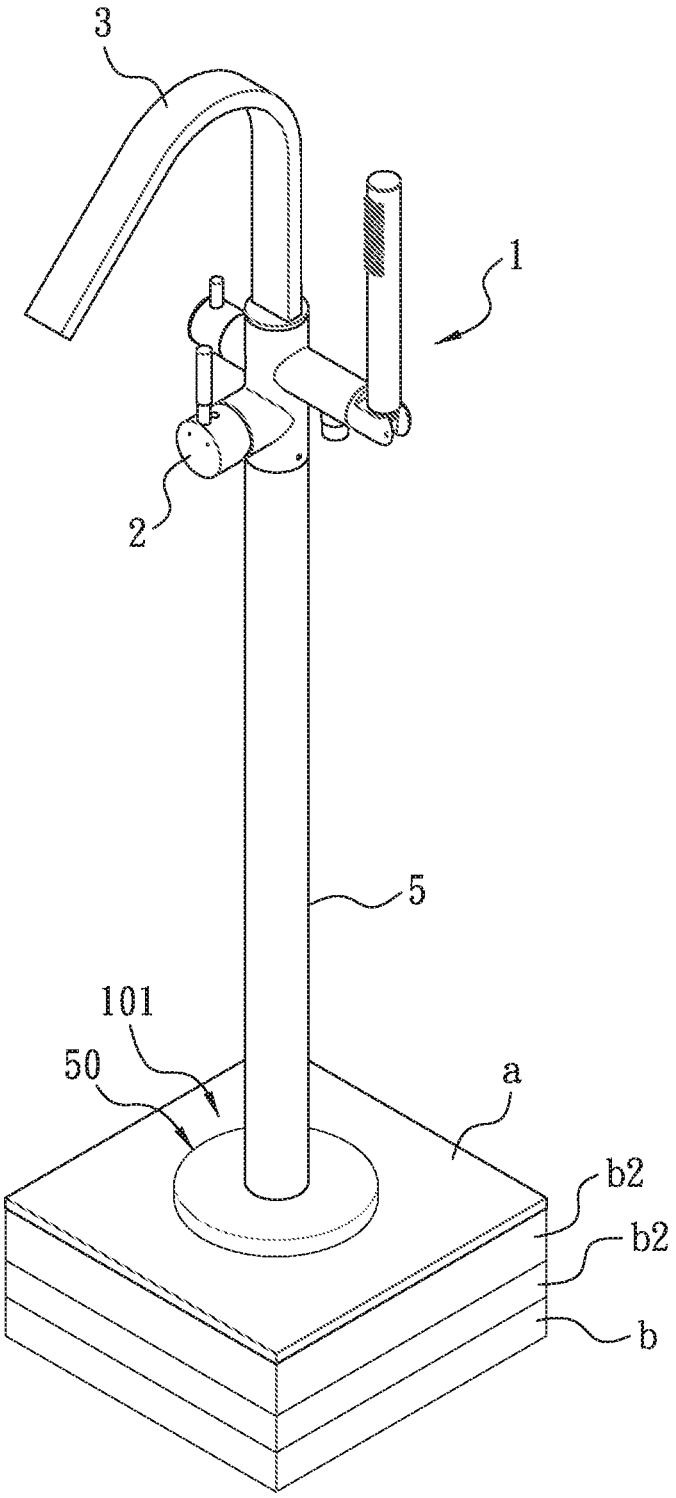
FIG. 9 is a perspective view of another embodiment of a rough-in assembly coupled to a free-standing faucet according to the present invention.
Figure 10:
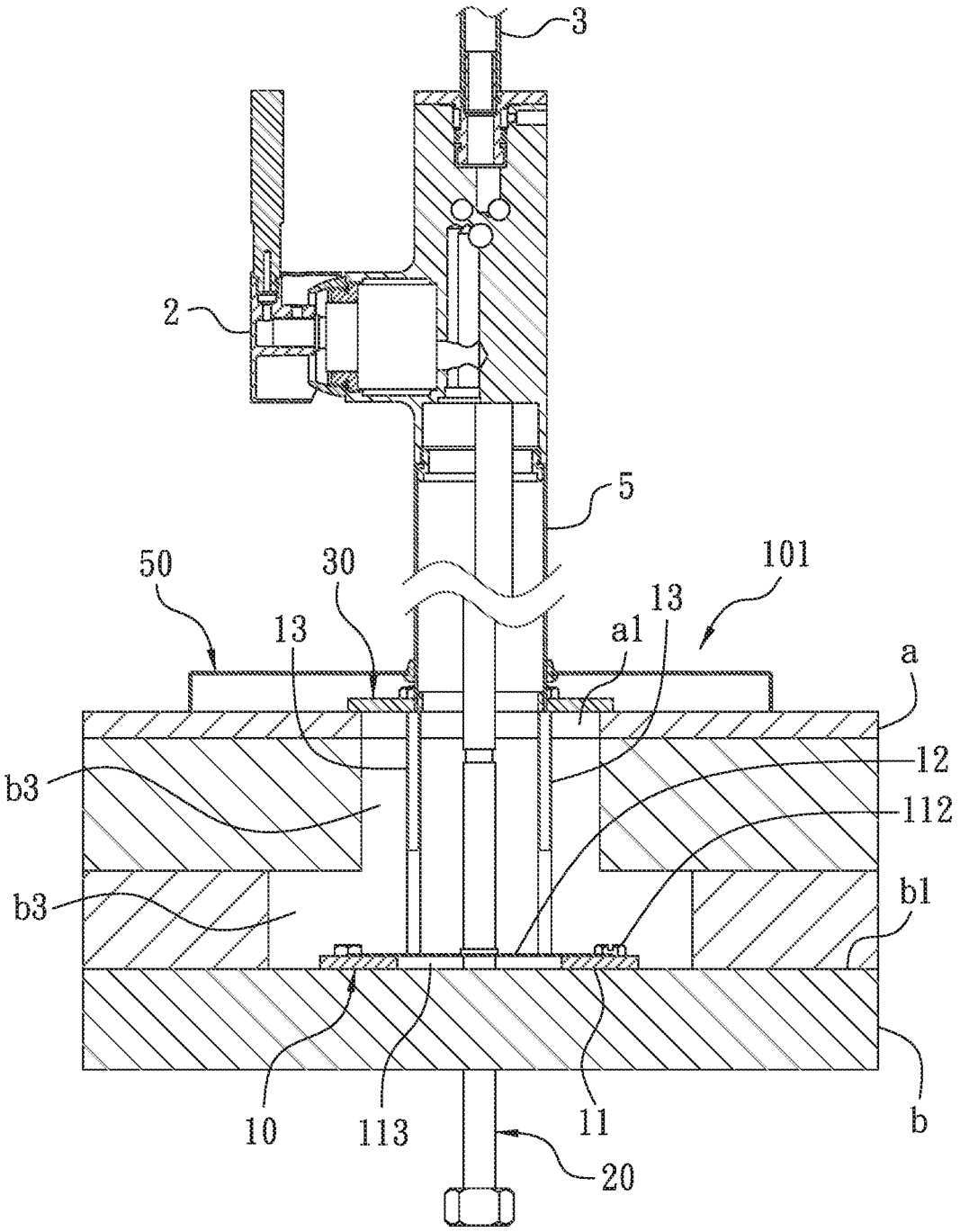
FIG. 10 is a partial longitudinal sectional view of the embodiment in FIG. 9 according to the present invention.
Figure 11:
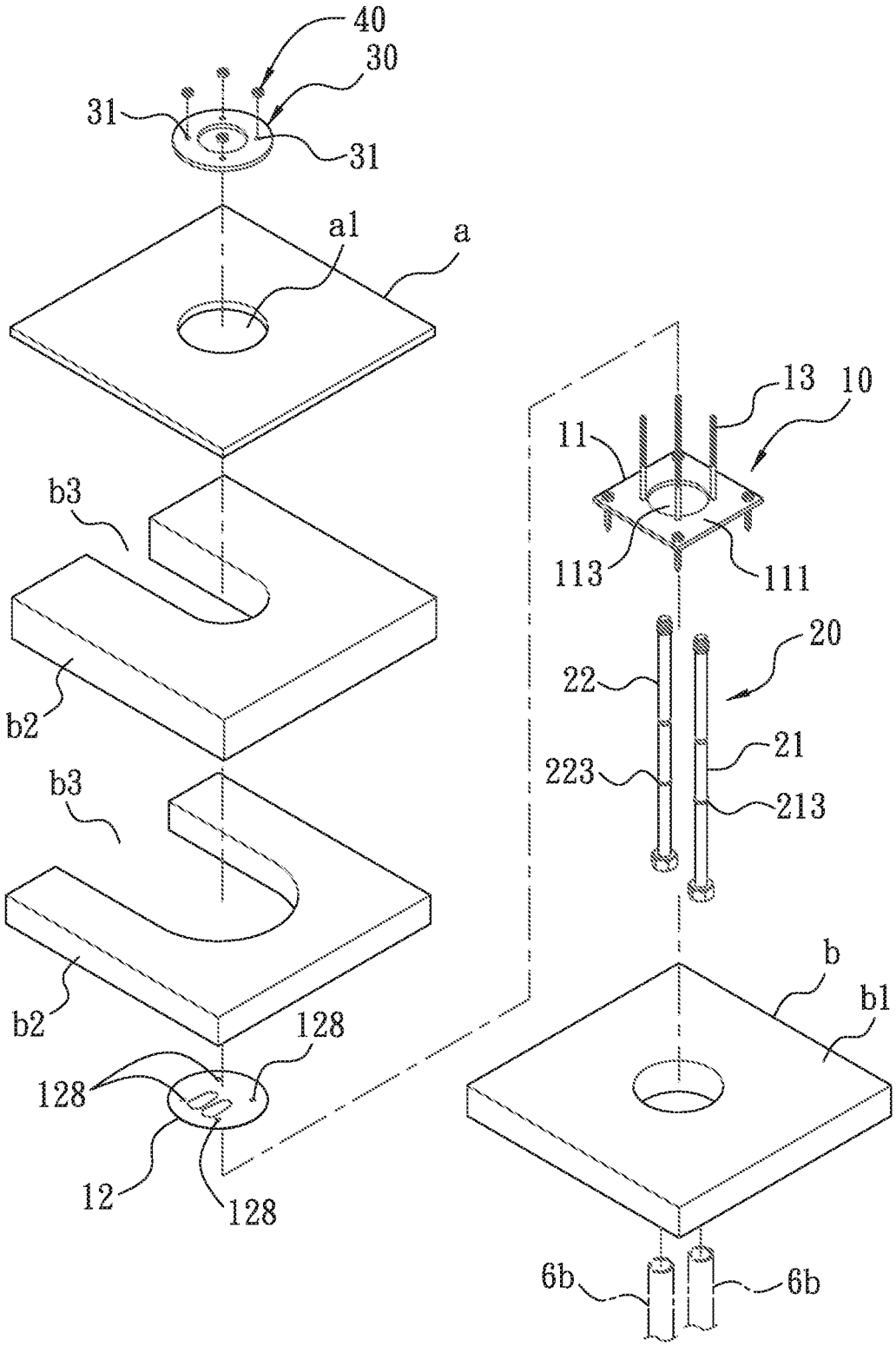
FIG. 11 is a partial explosive view of the embodiment in FIG. 9 with a cold-water supply pipe and a hot-water supply pipe according to the present invention.
Figure 12:
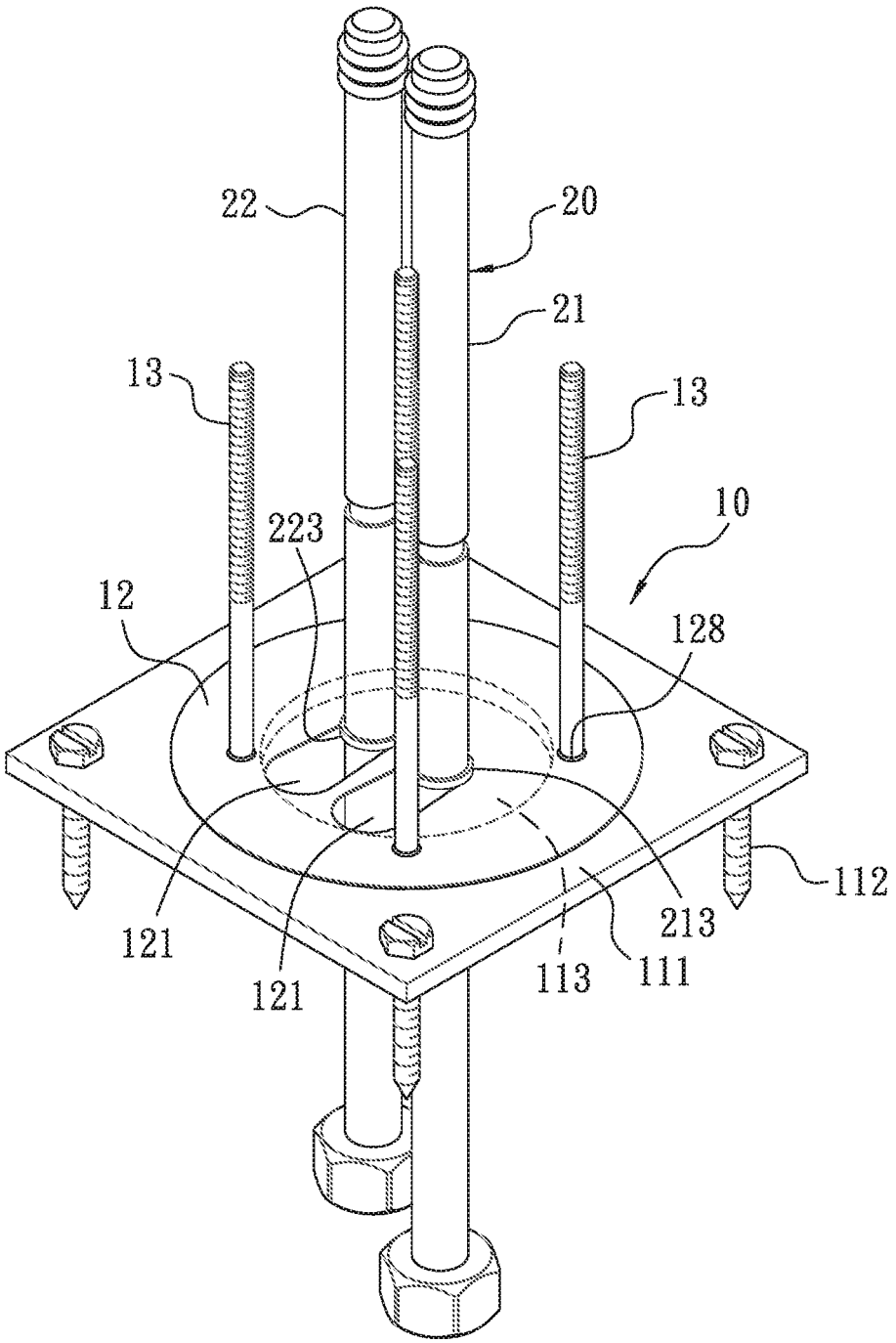
FIG. 12 is a perspective view of a part of a rough-in assembly of the embodiment in FIG. 9 according to the present invention.

Refer to FIG. 9, FIG. 10 and FIG. 11, another embodiment is disclosed. The difference between this embodiment of a rough-in assembly 101 and the above embodiment of the rough-in assembly 100 is in that: the rough-in assembly 101 is suitable for the cold-water supply pipe 6*a* and the hot-water supply pipe 6*b* arranged vertically while the rough-in assembly 100 is applied to the cold-water supply pipe 6*a* and the hot-water supply pipe 6*b* disposed horizontally. Thus the bottom plate 11 and the tube-fixing portion 12 of the mounting base 10 are a bit different from those of the above embodiment. More specifically, the bottom plate 11 of the mounting base 10 is fastened on the upper surface b1 of the laminated wood b and is provided with a through hole 113 that allows the cold-water connection tube 21 and the hot-water connection tube 22 of the connection tube set 20 to insert therethrough. Thus the connection tube set 20 is passed through the laminated wood b. As shown in FIG. 12, both the cold-water connection tube 21 and the hot-water connection tube 22 are straight tubes vertically inserted through the through hole 113 while those of the above embodiment are bent tubes. The tube-fixing portion 12 is a piece of plate provided with a plurality of positioning holes 128 and two openings that form the two locking slots 121. By the respective bolts 13 being inserted through and positioned in the respective positioning holes 128, the tube-fixing portion 12 (the piece of plate) can be abutting against and positioned on the upper surface 111 of the bottom plate 11.

Figure 13:
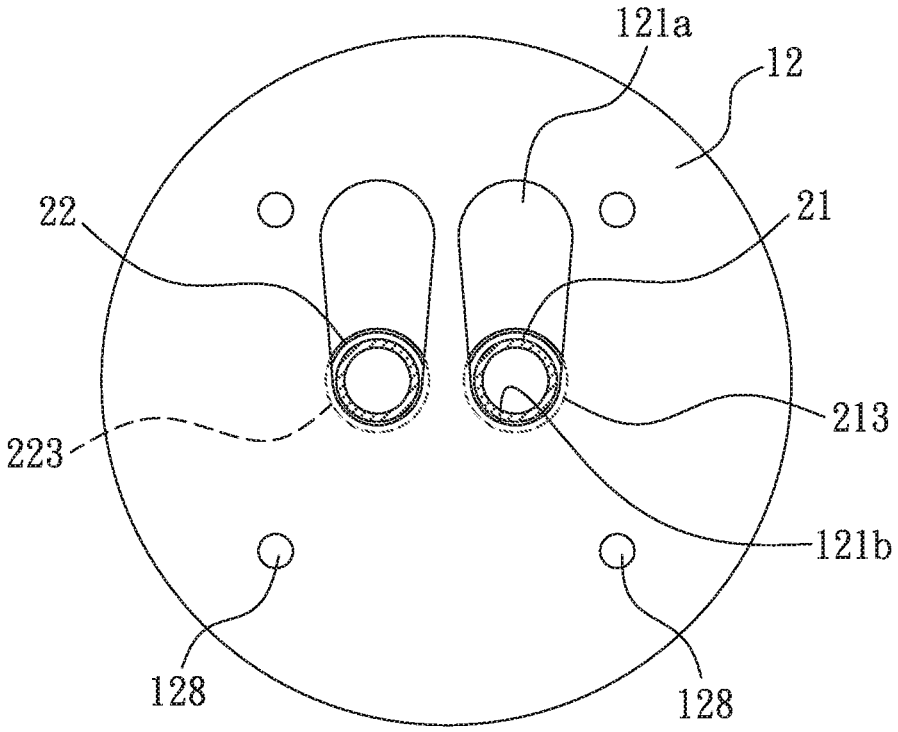
FIG. 13 is a bottom view of a tube-fixing portion assembled with a connection tube set of the embodiment in FIG. 9 according to the present invention.

More specifically, as shown in FIG. 12 and FIG. 13, the locking slot 121 is a slotted hole having one side thereof as an insertion side 121*a* and the other side thereof as a locking side 121*b*. The width of the insertion side 121*a* is larger than that of the locking side 121*b* so that both the cold-water connection tube 21 and the hot-water connection tube 22 are able to be inserted through the insertion sides 121*a* and then horizontally sliding into the locking sides 121*b* correspondingly.

A support circular flange 213 and a circular flange 223 are respectively formed on an outer peripheral wall of the cold-water connection tube 21 and an outer peripheral wall of the hot-water connection tube 22. The diameter of both the support circular flanges 213, 223 is between the width of the insertion side 121*a* and the width of the locking side 121*b* so that the wall surface of the support circular flange 213/223 is abutting against and supported by the upper surface at the locking side 121*b* of the piece of plate (the tube-fixing portion 12).

Figure 14:
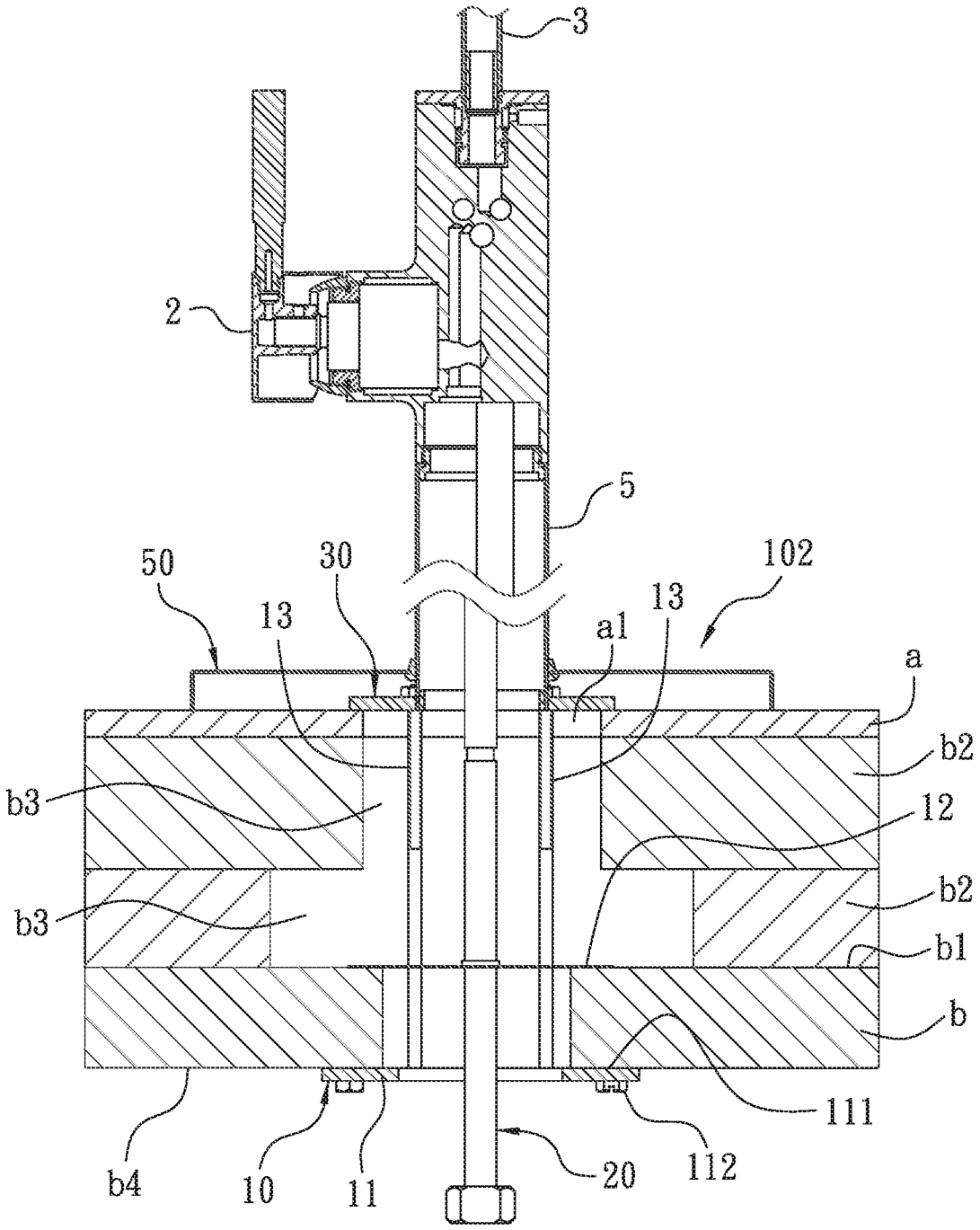
FIG. 14 is a perspective view of a further embodiment of a rough-in assembly coupled to a free-standing faucet according to the present invention.
Figure 15:
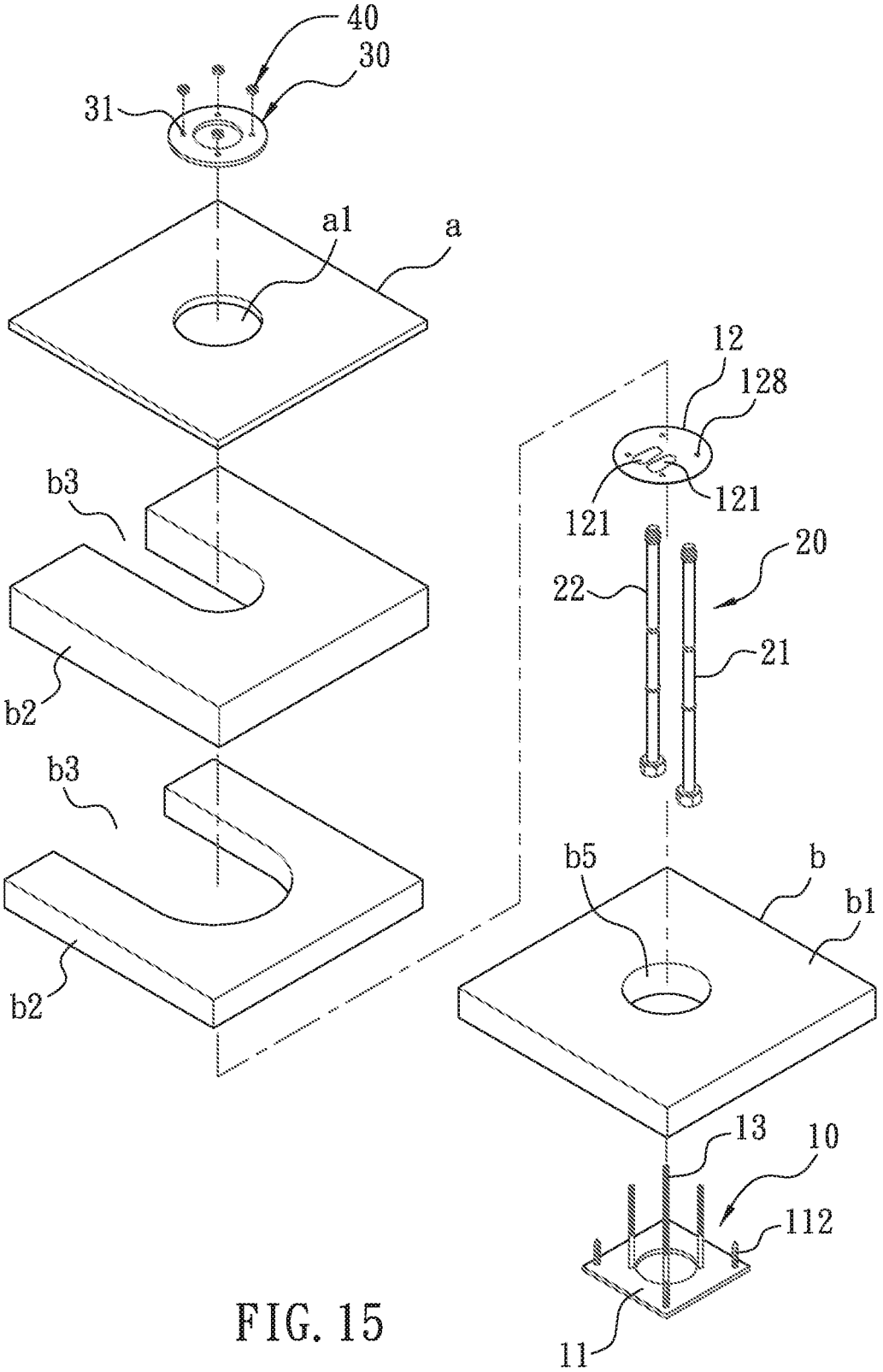
FIG. 15 is a partial explosive view of the embodiment in FIG. 14 used in combination with a floor, a laminated wood and pads according to the present invention.

Refer to FIG. 14 and FIG. 15, a further embodiment is disclosed. A rough-in assembly 102 of this embodiment and the rough-in assembly 101 of the above embodiment have similar structures. The difference between the rough-in assembly 102 and the above rough-in assembly 101 is in that: the bottom plate 11 is fastened on the lower surface b4 of the laminated wood b in this embodiment instead of being fastened on the upper surface b1 of the laminated wood b in the above embodiment. The respective bolts 13 extending upward from the upper surface of the upper surface 111 of the bottom plate 11 are passed through the laminated wood b and inserted through the respective positioning holes 128 of the tube-fixing portion 12 so that the tube-fixing portion 12 is abutting against and positioned on the upper surface 111 of the bottom plate 11. In order to make the bolts 13 pass through the laminated wood b smoothly, the laminated wood b is provided with a hole b5 which is formed or prepared in advance by the workers.

The installation of the rough-in assembly 101 of the second embodiment and the rough-in assembly 102 of the third embodiment is mostly the same as that of the rough-in assembly 100 of the first embodiment. The difference between the installation of the second and the third embodiments and that of the first embodiment is in that: the cold-water connection tube 21 and the hot-water connection tube 22 of the second and the third embodiments are straight tubes which are inserted through the through hole 113 of the bottom plate 11 and the wider insertion side 121*a* of the respective locking slots 121 on the tube-fixing portion 12 firstly and then moved horizontally to be mounted and secured firmly at the locking side 121*b* with smaller width.

In summary, the rough-in assembly 100, 101 or 102 of the present invention includes no passage in the mounting base so that there is no need to produce the base integrally by casting copper-based alloys. The rough-in assembly used in combination with only copper-based pipes has features of simple structure and easy production.

Thus the production cost is dramatically reduced. Moreover, the bottom plate 11 of the rough-in assembly 100, 101 or 102 is directly disposed on the laminated wood b. The design puts most of the weight of the free-standing faucet 1 on the laminated wood b. The free-standing faucet 1 is secured more stably and firmly after installation compared with the prior arts because that the laminated wood b provides a larger contact surface. Thus the free-standing faucet 1 will not shake or move around while in contact with users' hands in use.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalent.

What is claimed is:

1. A rough-in assembly used for mounting a free-standing faucet, which includes a valve assembly, a spout connected to the valve assembly, a free-standing casing tube connected to the valve assembly, and an inlet tube set connected to the valve assembly, mounted in the free-standing casing tube and having a cold-water inlet tube and a hot-water inlet tube, on a floor comprising:

a mounting base which includes a bottom plate being fixed on a laminated wood;

a plurality of bolts each of which is projecting from the upper surface of the bottom plate and inserted through a mounting hole on the floor to extend upward;

a tube-fixing portion positioned on the upper surface of the bottom plate and provided with two locking slots located in an area defined by the bolts;

a connection tube set which consists of a cold-water connection tube being locked and positioning in one of the two locking slots correspondingly and having a cold-water inlet end connected to a cold-water supply pipe and a cold-water outlet end connected to the cold-water inlet tube;

a hot-water connection tube being locked and positioning in another of the two locking slots correspondingly and having a hot-water inlet end connected to a hot-water supply pipe and a hot-water outlet end connected to the hot-water inlet tube;

a fixing plate which is connected to and arranged around the bottom end of the free standing casing tube and provided with a plurality of insertion holes which allow the respective bolts of the mounting base to pass therethrough; and a plurality of nuts threaded on the respective bolts of the mounting base for threading and fastening the fixing plate on the upper surface of the floor;

wherein the tube-fixing portion further includes first and second vertical plate portions opposite to each other and a horizontal plate portion connected between the vertical plate portions;

the two locking slots are spaced apart and disposed on both the first vertical plate portion and the horizontal plate portion;

for the two locking slots, a part of each locking slot located at the first vertical plate portion forms a vertical notch while a part of each locking slot arranged at the horizontal plate portion forms a horizontal notch which is communicating with the vertical notch;

both the cold-water connection tube and the hot-water connection tube are bent tubes each of which includes a horizontal portion, a vertical portion, and a curved portion located between the horizontal portion and the vertical portion;

the cold-water inlet end of the cold-water connection tube and the hot-water inlet end of the hot-water connection tube are respectively formed on rear ends of each horizontal portion while the cold-water outlet end of the cold-water connection tube and the hot-water outlet end of the hot-water connection tube are respectively arranged at rear ends of each vertical portion; and for both connection tubes, a part of the vertical portion close to the curved portion is locked and positioned in the horizontal notch of each locking slot while a part of the horizontal portion close to the curved portion is locked and positioned in the vertical notch of each locking slot.

2. The rough-in assembly as claimed in claim 1, wherein one side of the horizontal notch of each locking slot away from an entry side of each locking slot is curved and has a locking portion whose width is smaller than the width of a rest part of each locking slot so that the vertical portions of the cold-water and hot-water connection tubes are locked and positioned firmly in the locking portions after being laterally mounted into the two locking slots.

3. The rough-in assembly as claimed in claim 1, wherein the first vertical plate portion horizontally extends outward to form a connection plate which is fixed on the upper surface of the bottom plate.

4. The rough-in assembly as claimed in claim 3, wherein the respective bolts of the mounting base are projecting from the upper surface of the connection plate.

5. A rough-in assembly, used for mounting a free-standing faucet, which includes a valve assembly, a spout connected to the valve assembly, a free-standing casing tube connected to the valve assembly, and an inlet tube set connected to the valve assembly, mounted in the free-standing casing tube and having a cold-water inlet tube and a hot-water inlet tube, on a floor comprising:

a mounting base which includes a bottom plate being fixed on a laminated wood, a plurality of bolts each of which is projecting from the upper surface of the bottom plate and inserted through a mounting hole on the floor to extend upward, and a tube-fixing portion positioned on the upper surface of the bottom plate and provided with two locking slots located in an area defined by the bolts;

a connection tube set which consists of a cold-water connection tube being locked and positioning in one of the two locking slots correspondingly and having a cold-water inlet end connected to a cold-water supply pipe and a cold-water outlet end connected to the cold-water inlet tube, and a hot-water connection tube being locked and positioning in another of the two locking slots correspondingly and having a hot-water inlet end connected to a hot-water supply pipe and a hot-water outlet end connected to the hot-water inlet tube;

a fixing plate which is connected to and arranged around the bottom end of the free standing casing tube and provided with a plurality of insertion holes which allow the respective bolts of the mounting base to pass therethrough;

and a plurality of nuts threaded on the respective bolts of the mounting base for threading and fastening the fixing plate on the upper surface of the floor, wherein the bottom plate of the mounting base is fixed on the upper surface of the laminated wood and is provided with a through hole so that the cold-water connection tube and the hot-water connection tube of the connection tube set are able to be inserted through the through hole and passed through the laminated wood;

the tube-fixing portion is a piece of plate provided with a plurality of positioning holes and two openings that form the two locking slots; and the tube-fixing portion is abutting against and positioned on the upper surface of the bottom plate by the bolts being inserted through and positioned in the positioning holes.

6. The rough-in assembly as claimed in claim 5, wherein each locking slot is a slotted hole having one side thereof as an insertion side and the other side thereof as a locking side; the width of each insertion side is larger than the width of each locking side so that both the cold-water connection tube and the hot-water connection tube are able to be inserted through each insertion side and then horizontally sliding into each locking side correspondingly.

7. The rough-in assembly as claimed in claim 6, wherein an outer peripheral wall of both the cold-water connection tube and the hot-water connection tube is provided with a support circular flange; the diameter of each support circular flange is between the width of each insertion side and the width of each locking side so that the wall surface of each support circular flange is able to be abutting against and supported by the upper surface on the locking sides of each slotted hole on the tube-fixing portion.

8. The rough-in assembly as claimed in claim 5, wherein the respective bolts of the mounting base are projecting from the upper surface of the bottom plate.

9. The rough-in assembly as claimed in claim 5, wherein the bottom plate is fixed on the upper surface of the laminated wood by a plurality of fasteners.

10. The rough-in assembly as claimed in claim 9, wherein the fasteners are screws.

11. A rough-in assembly used for mounting a free-standing faucet, which includes a valve assembly, a connected to the valve assembly, a free-standing casing tube connected to the valve assembly, and an inlet tube set connected to the valve assembly, mounted in the free-standing casing tube and having a cold-water inlet tube and a hot-water inlet tube, on a floor comprising:

a mounting base which includes a bottom plate being fixed on a laminated wood, a plurality of bolts each of which is projecting from the upper surface of the bottom plate and inserted through a mounting hole on the floor to extend upward, and a tube-fixing portion positioned on the upper surface of the bottom plate and provided with two locking slots located in an area defined by the bolts;

a connection tube set which consists of a cold-water connection tube being locked and positioning in one of the two locking slots correspondingly and having a cold-water inlet end connected to a cold-water supply pipe and a cold-water outlet end connected to the cold-water inlet tube, and a hot-water connection tube being locked and positioning in another of the two locking slots correspondingly and having a hot-water inlet end connected to a hot-water supply pipe and a hot-water outlet end connected to the hot-water inlet tube;

a fixing plate which is connected to and arranged around the bottom end of the free standing casing tube and provided with a plurality of insertion holes which allow the respective bolts of the mounting base to pass therethrough and a plurality of nuts threaded on the respective bolts of the mounting base for threading and fastening the fixing plate on the upper surface of the floor;

wherein the bottom plate of the mounting base is fixed on the lower surface of the laminated wood and is provided with a through hole so that the cold-water connection tube and the hot-water connection tube of the connection tube set are able to be inserted through the through hole and passed through the laminated wood;

the tube-fixing portion is a piece of plate provided with a plurality of positioning holes and two openings that form the two locking slots; and the tube-fixing portion is abutting against and positioned on the upper surface of the bottom plate by the bolts being inserted through and positioned in the positioning holes.

12. The rough-in assembly as claimed in claim 11, wherein each locking slot is a slotted hole having one side thereof as an insertion side and the other side thereof as a locking side; the width of each insertion side is larger than the width of each locking side so that both the cold-water connection tube and the hot-water connection tube are able to be inserted through each insertion side and then horizontally sliding into each locking side correspondingly.

13. The rough-in assembly as claimed in claim 11, wherein an outer peripheral wall of both the cold-water connection tube and the hot-water connection tube is provided with a support circular flange; the diameter of each support circular flange is between the width of each insertion side and the width of each locking side so that the wall surface of each support circular flange is able to be abutting against and supported by the upper surface on the locking sides of each slotted hole on the tube-fixing portion.

14. The rough-in assembly as claimed in claim 11, wherein the respective bolts of the mounting base are projecting from the upper surface of the bottom plate.

15. The rough-in assembly as claimed in claim 11, wherein the bottom plate is fixed on the lower surface of the laminated wood by a plurality of fasteners.

16. The rough-in assembly as claimed in claim 15, wherein the fasteners are screws.

* * * * *